United States Patent [19]

Morane et al.

[11] Patent Number: 4,854,759

[45] Date of Patent: Aug. 8, 1989

[54] DEVICE FOR APPLYING A LIQUID, PRODUCT, IN PARTICULAR FOR APPLYING NAIL POLISH

[75] Inventors: Bruno Morane, Neuilly; Gérard Joulia, Paris, both of France

[73] Assignee: L'Oreal, Paris, France

[21] Appl. No.: 216,205

[22] Filed: Jul. 7, 1988

[30] Foreign Application Priority Data

Jul. 10, 1987 [FR] France ..... 87 09819

[51] Int. Cl.[4] ..... A45D 34/00; A46B 11/00

[52] U.S. Cl. ..... 401/119; 401/115; 401/126; 401/127; 401/129; 401/274

[58] Field of Search ..... 401/118, 119, 126, 129, 401/101, 115, 274, 127

[56] References Cited

U.S. PATENT DOCUMENTS

| | | | |
|---|---|---|---|
| 2,290,576 | 7/1942 | Scioscia | 401/119 |
| 2,691,184 | 10/1954 | Miller et al. | 401/129 |
| 2,869,162 | 1/1959 | Pritz | 401/119 X |
| 3,420,611 | 1/1969 | Towns | 401/115 |
| 4,219,283 | 8/1980 | Buckley et al. | 401/129 |
| 4,594,014 | 6/1986 | Korper . | |

FOREIGN PATENT DOCUMENTS

| | | | |
|---|---|---|---|
| 786508 | 6/1968 | Canada | 401/129 |
| 1925082 | 2/1970 | Fed. Rep. of Germany . | |
| 742193 | 3/1933 | France . | |
| 940464 | 12/1948 | France . | |
| 2349511 | 11/1977 | France . | |
| 2585934 | 2/1987 | France | 401/129 |
| 2178647 | 7/1986 | United Kingdom . | |

*Primary Examiner*—Steven A. Bratlie

*Attorney, Agent, or Firm*—Cushman, Darby & Cushman

[57] ABSTRACT

The device (1) includes an applicator brush (4) including a rod (5) provided with applicator means (A) such as bristles (6). The rod (5) is carried by a cap (7) intended to close the neck, and this cap is integrally joined to a sheath (9) capable of surrounding the rod (5). The rod (5) is mounted displaceably in the sheath (9) with respect to the cap (7), and at its end remote from the cap, the sheath (9) includes a restriction (11), through which the applicator means (A) of the brush can pass. The rod (5) of the brush includes an enlargement (12) arranged to come into contact with the restriction (11) by gravity, when the brush (4) is oriented downward, so as to retain the rod and close the restriction. Toward the cap, the sheath (9) includes at least one opening (14, 15) allowing liquid to enter the sheath when the bottle, closed by the cap, is inverted, and a free space (16) exists between the inside surface of the sheath and the outer surface of the rod to form a reservoir for the liquid. The length (L) of the sheath is greater than that (1) of the rod, such that the rod (5) can retract inside the sheath (9), which assures the opening of the restriction.

6 Claims, 2 Drawing Sheets

DEVICE FOR APPLYING A LIQUID, PRODUCT, IN PARTICULAR FOR APPLYING NAIL POLISH

FIELD OF THE INVENTION

The invention relates to a device for applying a liquid product contained in a bottle, of the type that includes an applicator brush including a rod provided with applicator means, such as bristles; the rod is carried by a cap or the like, which is intended for closing the neck of the bottle and is integrally joined to a sheath that surrounds the rod and, when the cap is fixed on the neck, projects into the interior of the bottle, with the brush located inside the bottle. More particularly, but not exclusively, the invention relates to a device for applying nail polish.

BACKGROUND OF THE INVENTION

As is well known, the use of such applicator devices including a brush necessitates periodically dipping the brush into the liquid to reload it with the product.

Various solutions for increasing the length of time the brush can be used outside the bottle, and hence substantially to reduce the number of times that it must be dipped into the bottle in order to cover a predetermined surface area with the product, have already been proposed.

French Patent Application No. 2 585 934 relates to an applicator device of this type.

SUMMARY OF THE INVENTION

The primary object of the invention is to furnish an applicator device of the above-defined generic type that can be used for a long period without being returned to the bottle, while having an economical and dependable construction and being simple to use.

According to the invention, this object is attained by a device for applying a liquid product contained in a bottle, in particular for applying nail polish, of the generic type defined above, in which the rod of the brush is mounted such that it is displaceable in the sheath with respect to the cap; at its end remote from the cap, the sheath includes a restriction through which the applicator means in the form of a brush can pass, and the rod of the brush includes an enlargement arranged to press against the restriction under the influence of gravity when the brush is oriented downward, so as to retain the rod and close the restriction. The sheath includes at least one opening near the cap enabling the entry of liquid into the sheath when the bottle, closed by the cap, is inverted, and there is a free space between the inside surface of the sheath and the surface of the rod to form a reservoir for the liquid. The length of the sheath is greater than that of the rod, such that the rod can be retracted into the sheath, which assures at least partial opening of the restriction.

Preferably, the rod of the brush has a portion of increased diameter, forming a head, on its end remote from the applicator means.

Advantageously, the rod of the brush may include a zone of reduced diameter between the enlargement and the portion of increased diameter, and the zone of reduced diameter and the inside surface of the sheath define an annular chamber.

The length of this annular chamber is such that when the rod is retracted to the maximum in the sheath and comes to rest against the cap, the opening or openings in the sheath open at least partly into this annular chamber.

Preferably, the lengths of the various elements are selected so that the end of the applicator means remains outside the sheath when the rod is retracted to the maximum inside the sheath and is in contact with the cap.

The enlargement of the rod of the brush, arranged to come into contact with the restriction of the sheath, advantageously comprises the ferrule of the applicator brush; the ferrule assures the retention of the bristles of the brush.

Aside from the above-described arrangements, the invention also includes a certain number of other arrangements to be described in further detail below, in terms of a particular exemplary embodiment which is described in conjunction with the appended drawings, but is not to be considered limiting in any way.

DESCRIPTION OF THE PREFERRED EMBODIMENT

Figure 1:
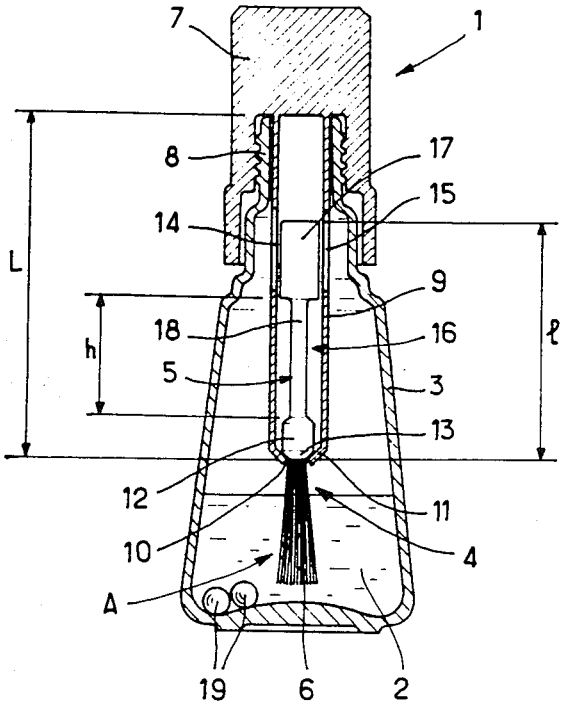
FIG. 1 is a vertical sectional view of a bottle of a liquid product equipped with a device for applying the product in accordance with the invention, the bottle being in the vertical storage position.

Turning to FIG. 1 of the drawings, a device 1 for applying a liquid product 2 contained in a bottle 3 can be seen. In the example shown, the bottle 3 is a bottle of nail polish containing the liquid product 2.

The device 1 includes an applicator brush 4 that includes a rod 5 provided with applicator means A formed by bristles 6; as described below, the rod 5 is carried by a cap 7 intended for closing the neck 8 of the bottle, preferably by screwing; complementary threads are provided on the outer surface of the neck 8 and the inside surface of a socket in the cap 7, respectively. This cap can be removed from the neck 8, in order to apply the product with the brush 4.

The cap 7 is integrally joined to a sheath 9 comprising a kind of quill arranged to enter into the neck 8 and to project into the interior of the bottle 3 when the cap 7 is fixed on the neck 8, with the brush 4 located inside the bottle 3. The sheath 9 surrounds and carries the rod 5 of the brush.

This rod 5 is mounted such that it is displaceable in the sheath 9 with respect to the cap 7.

At its end remote from the cap, the sheath 9 includes a constricted opening 10 located at the end of a restriction 11 formed by a frustoconically shaped end. The diameter of the opening 10 is sufficient to allow the bristles 6 of the brush to pass through this opening.

The rod 5 of the brush includes an enlargement 12 arranged to come into contact with the restriction 11 when the brush 4 is oriented with its bristles 6 downward; toward the bristles 6, this enlargement 12 includes a frustoconical surface 13 having the same inclination as the inside surface of the wall 11, and this surface 13 is capable of pressing against the wall 11 in a substantially sealed manner.

The enlargement 12 makes it possible to retain the rod 5 inside the sheath and to close the opening 10.

Figure 2:
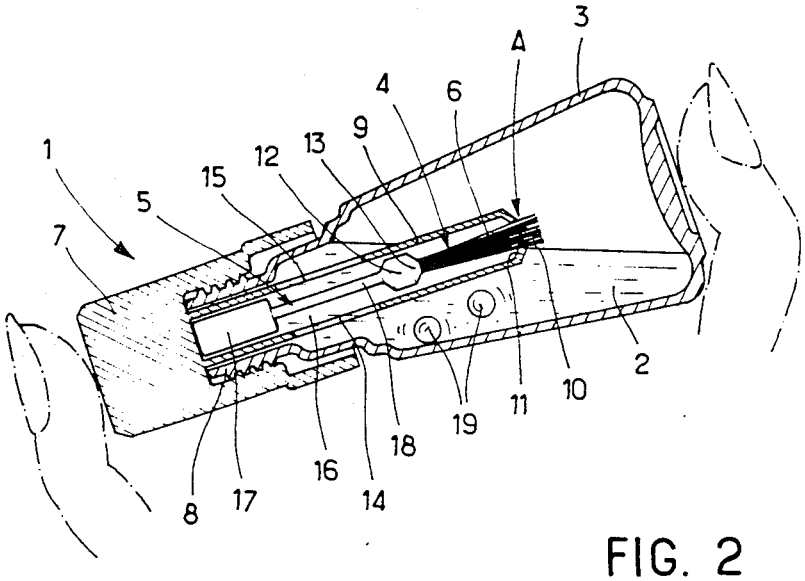
FIG. 2 is a sectional view illustrating the preparatory phase prior to applying the product, in which the closed bottle is inverted.

Toward the cap 7, the sheath 9 includes two diametrically opposed openings 14, 15 provided in the wall of the sheath. These openings 14, 15 allow the entry of the liquid 2 into the sheath 9 when the bottle 3, closed with the cap 7, is inverted as shown in FIG. 2.

A free space 16 of annular shape exists between the inside surface of the sheath 9 and the outside surface of the rod 5, to act as a reservoir for the liquid.

Figure 4:
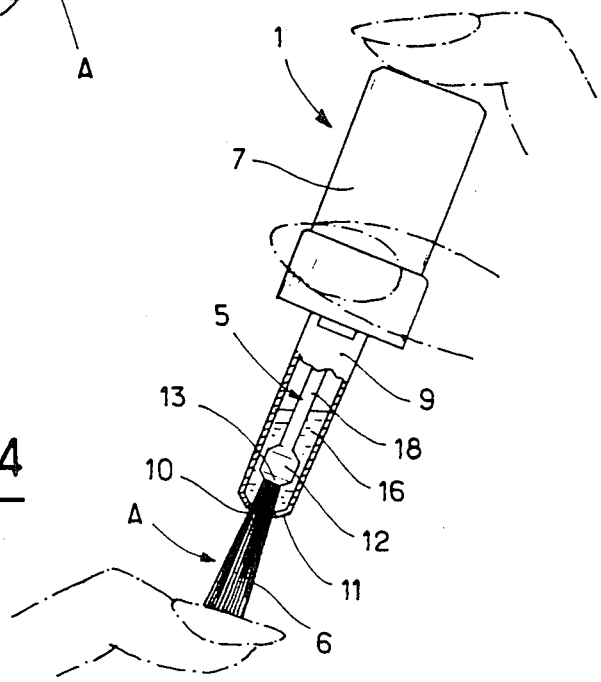
FIG. 4 illustrates a phase of reloading the bristles of the brush with liquid product, in the course of an application thereof.

The length L (FIG. 1) of the sheath 9 is greater than the length <1> of the rod 5 in such a manner that this rod can be retracted into the sheath, which assures the opening of the restriction 11, as shown in FIG. 4.

At its end remote from the bristles 6, the rod 5 of the brush includes a portion 17 of increased diameter, forming a head. This portion 17, which is cylindrical in shape, has an outside diameter slightly less than the inside diameter of the sheath 9 and contributes to the sliding guidance of the rod 5 in this sheath. This portion 17 lends the rod 5 sufficient weight so that the enlargement 12 closes the opening 10, thus forming a valve for the liquid that is enclosed within the sheath 9.

Between the enlargement 12 and the portion 17, the rod 5 includes a zone 18 of reduced diameter, which with the inside surface of the sheath 9 defines the space or annular chamber 16.

The length h of the annular chamber 16 is such that when the rod is retracted to the maximum and with its portion 17 comes to rest against the cap 7, as shown in FIG. 2, the openings 14, 15 of the sheath 9 become fully open into the chamber 16. Beads 19, two in number, for example, are provided in the bottle 3 inthe conventional manner, to promote the agitation of the liquid 2 when the bottle 3 is shaken.

The use and functioning of the device 1 are as follows.

In the normal storage position, the bottle 3 is vertical, with its neck 8 turned upward, as shown in FIG. 1; the cap 7 closes the bottle. A user desiring to make use of the device 1 to apply the product 2 onto a surface begins by grasping the bottle 3 and inverting it, as shown in FIG. 2, perhaps shaking it as well. The liquid 2 flows toward the neck 8.

Under the influence of gravity, the rod 5 retracts into the sheath 9 until the portion 17 comes into contact with the cap 7; for the majority of their length, the bristles 6 withdraw inside the sheath 9. Nevertheless, the ends of the bristles 6 remain outside this sheath 9; the length of the various parts is selected such that this result will be obtained.

Through the openings 14 and 15, the liquid 2 penetrates to the interior of the sheath 9.

The user returns the bottle 3 to its normal vertical storage position, with the cap 7 at the top. Under the influence of gravity, the rod 5 moves downward inside the sheath 9, until the enlargement 12 comes into contact with the restriction 11 and closes the opening 10. Liquid 2 is now trapped within the annular space 16.

The user now unscrews the cap 7 from the neck and removes the device 1 provided with the brush 4 from the bottle 3.

Figure 3:
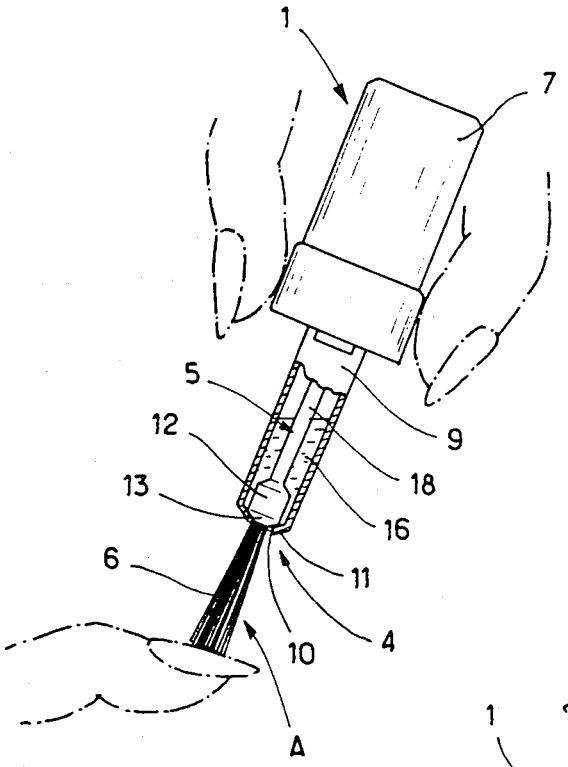
FIG. 3 illustrates the application of nail polish with the aid of the device in accordance with the invention.

The user can now begin to apply the liquid 2, that is, nail polish, to a nail as shown in FIG. 3. During this phase of application, the user spreads the product onto a nail with the aid of the bristles 6, holding the cap 7 without exercising downward pressure. Under these conditions, the enlargement 12 remains in contact with the restriction 11 and closes the opening 10 as can be seen in FIG. 3.

When the liquid 2 that impregnated the bristles 6 at the beginning of the application begins to be depleted, the user can reload the bristles 6 with liquid by exerting a slight pressure on the cap 7 toward the bottom, while the bristles 6 are in contact with the nail. As a result, a relative displacement between the rod 5 and the cap 7 takes place. The enlargement 12 moves inside the sheath 9 and uncovers the opening 10 in such a manner that liquid product 2 contained in the sheath 9 can drain over the enlargement 12 onto the bristles 6 and reload them.

Whenever the user thinks that the reloading of the bristles is sufficient, she lifts the cap 7 until the enlargement 12 once again closes the opening 10.

The user can continue the application of the product 2 until the liquid initially contained in the sheath 9 is exhausted.

The device according to the invention assures a long period available for applying the liquid, without having to redip the brush into the bottle. It is easy to use and simple in construction.

What is claimed is:

1. A device for applying a liquid product contained in a bottle, containing an applicator brush including a rod provided with applicator means such as bristles, the rod being carried by a cap intended for closing the neck of the bottle, the cap being integrally joined to a sheath arranged to surround the rod and project into the interior of the bottle, when the cap is fixed on the neck, with the brush situated inside the bottle, characterized in that the rod of the brush is mounted displaceably in the sheath with respect to the cap, the sheath including, at its end remote from the cap, a restriction through which the applicator means can pass, the rod of the brush including an enlargement arranged to come into contact with the restriction under the influence of gravity, when the brush is oriented downwardly, in such a manner as to retain the rod and close the restriction, the sheath including at least one opening near the cap which permits the entry of the liquid into the sheath when the bottle, closed by the cap, is inverted, a free space existing between the inside surface of the sheath and the surface of the rod to define a liquid reservoir, the length of the sheath being greater than that of the rod, such that the rod can retract inside the sheath, which assures the opening of the restriction.

2. A device as defined by claim 1, characterized in that the rod of the brush, at its end remote from the applicator means, has a portion of increased diameter forming a head.

3. A device as defined by claim 2, characterized in that between the enlargement and the portion of increased diameter, the rod of the brush includes a zone of reduced diameter which with the inside surface of the sheath defines said free space.

4. A device as defined by claim 3, characterized in that the length of the free space is such that when the rod is retracted to the maximum inside the sheath and comes into contact with the cap, the opening of the sheath opens at least partially into this free space.

5. A device as defined by claims 1 or 2, characterized in that the end of the applicator means remains outside the sheath when the rod is retracted to the maximum inside the sheath and is in contact with the cap.

6. A device as defined by claims 1 or 2, characterized in that the enlargement of the rod of the brush, arranged to come into contact with the restriction of the sheath, comprises the ferrule of the applicator brush, the ferrule assuring the retention of the bristles of the brush.

* * * * *